US010647505B2

(12) United States Patent
Sherrard

(10) Patent No.: US 10,647,505 B2
(45) Date of Patent: May 12, 2020

(54) BIN LID CLOSING DEVICE

(71) Applicant: Sherrard PTY LTD, Floreat (AU)

(72) Inventor: Janelle Faye Sherrard, Floreat (AU)

(73) Assignee: SHERRARD PTY LTD, West Leederville (AU)

( * ) Notice: Subject to any disclaimer, the term of this patent is extended or adjusted under 35 U.S.C. 154(b) by 0 days.

(21) Appl. No.: 15/571,638

(22) PCT Filed: May 4, 2016

(86) PCT No.: PCT/AU2016/050321

§ 371 (c)(1),
(2) Date: Nov. 3, 2017

(87) PCT Pub. No.: WO2016/176730

PCT Pub. Date: Nov. 10, 2016

(65) Prior Publication Data

US 2018/0141749 A1 May 24, 2018

(30) Foreign Application Priority Data

May 4, 2015 (AU) ..... 2015901587
Aug. 20, 2015 (AU) ..... 2015903382

(51) Int. Cl.
*B65F 1/14* (2006.01)
*B65F 1/16* (2006.01)
*B65D 43/26* (2006.01)

(52) U.S. Cl.
CPC ..... *B65F 1/1623* (2013.01); *B65F 1/1615* (2013.01)

(58) Field of Classification Search
CPC .... B65F 1/1623; B65F 1/1615; B65F 1/1421; B65F 1/00; B65F 1/1457; B65F 1/163;
(Continued)

(56) References Cited

U.S. PATENT DOCUMENTS 1,045,927 A * 12/1912 Zeleny ..... A47K 13/12 4/236
1,427,472 A * 8/1922 Huber ..... B65F 1/1447 220/264

(Continued)

FOREIGN PATENT DOCUMENTS

WO 0009410 2/2000
WO 2014085848 6/2014

OTHER PUBLICATIONS

International Search Report dated Jun. 8, 2016, issued in corresponding PCT Application No. PCTAU/2016/050321.

*Primary Examiner* — Gideon R Weinerth
(74) *Attorney, Agent, or Firm* — Onello & Mello LLP

(57) ABSTRACT

A device for use on or with bins for the purpose of returning a bin lid to a closed position and/or to retain a bin lid in a closed position. The device includes a lid engaging portion, a bin engaging portion and an intermediate portion between the lid engaging and bin engaging portions. The intermediate portion is arranged, in use, around, within and/or adjacent to a handle of the bin. The bin engaging portion extends outwardly from the intermediate portion. The lid engaging portion extends outwardly from the intermediate portion. The lid engaging portion is movable between a first (lid is closed) and a second (lid is at least partially open) position. The intermediate portion provides resistance to the lid as the lid engaging portion is moved from the first position towards the second position causing the lid engaging portion to bias the lid towards a closed position.

42 Claims, 12 Drawing Sheets

(58) Field of Classification Search
CPC ..... B65F 2001/1653; B65F 2001/1669; B65F 2001/1676; B65F 1/1473; B65F 1/1646; B65F 1/14; E05F 1/1041; E05F 1/1008; E05F 1/1016
USPC ..... 16/76, 308; 220/830, 263, 264, 908, 827
See application file for complete search history.

(56) References Cited

U.S. PATENT DOCUMENTS

| | | | | |
|---|---|---|---|---|
| 2,557,048 | A | 6/1951 | Haase | |
| 2,670,197 | A * | 2/1954 | Morse | E05F 1/1215 16/76 |
| 2,755,500 | A * | 7/1956 | Floehr | E05F 1/1215 16/76 |
| 4,524,438 | A * | 6/1985 | Einhaus | E05F 1/1215 16/306 |
| 6,477,736 | B1 * | 11/2002 | Abernathy | E05F 1/1016 16/72 |
| 2003/0173369 | A1 * | 9/2003 | Nikolaus | A45D 40/221 220/830 |
| 2008/0094224 | A1 * | 4/2008 | Parker | B65F 1/1484 340/572.8 |
| 2010/0006572 | A1 * | 1/2010 | Chiou | B65F 1/1607 220/263 |
| 2015/0298904 | A1 | 10/2015 | Sherrard et al. | |
| 2016/0023847 | A1 * | 1/2016 | Guild | B65F 1/1623 49/386 |
| 2017/0320667 | A1 * | 11/2017 | Stone | B65F 1/1615 |
| 2018/0141749 | A1 * | 5/2018 | Sherrard | B65F 1/1615 |
| 2018/0319589 | A1 * | 11/2018 | Foster | B65F 1/1615 |

* cited by examiner

BIN LID CLOSING DEVICE

FIELD OF THE INVENTION

The present invention relates to a device for use on bins to return a bin lid to a closed position and/or retain a bin lid in the closed position.

BACKGROUND TO THE INVENTION

Bins at residential sites, commercial sites and municipal public sites for household, municipal garden and public space rubbish and recyclables, are generally collected by trucks with an automated mechanism for lifting and emptying. A common type of bin is frequently referred to as a 'wheelie bin'. However, trucks can also collect other types of bins, also having a bin lid hingedly attached to a body of the bin.

The mechanism includes an arm which lifts and upturns the bin such that the lid of the bin falls open and the contents of the bin fall into the rubbish container of the truck. When the bin has been emptied into the truck, the mechanism is controlled to return the bin upright and replace it on the ground, and then release the bin.

Often when the emptied bin is returned to the ground, the lid will remain in the open position. This can be undesirable for a number of reasons. For example, the bin will collect water if it is raining. Also, if the lid remains open, unwanted odours within the bin might be more noticeable.

In addition, if the bin is not fully emptied, vermin and pests, such as birds, mice, rats, insects etc. can be attracted to the rubbish, with the potential to spread disease or spread the rubbish from the bin around the local environment.

Further, when the bin is full or partially filled, it is often desirable to keep the lid closed to prevent the contents of the bin being accessed and/or strewn outside and about the bin by birds or vermin, or being carried about by wind.

Furthermore, bins at windy sites, such as coastal or valley sites, or between buildings, tend to be blown open, particularly if the bin lid is not fully closed (often due to the bin being overfilled and the lid 'propped' open by the pile of rubbish above the top edge of the body of the bin).

Devices exist which, when engaged with the bin, prevent the lid from being fully opened. An example of such a device is often known as a 'wheelie bin stand.' Typically, such devices, commonly used for bins located in public spaces, secure the bin and restrict ability to open the lid. These devices prevent the lid from being opened past a certain point, such that there is typically no more than about a 10 to 20 cm gap through which to deposit articles into the bin. Such devices therefore limit what may be put into the bin, since the size of some articles will be too great to fit through the gap. These types of devices are therefore unsuitable if the bin is intended to receive relatively larger articles or if it desired to have the ability to fully open the lid.

Other devices exist which attach to a front of the bin and lid, effectively clipping or clamping the lid in a closed position. If it is desired to open the lid or allow the lid to be opened, such devices must first be unclipped from the bin. This can be both inconvenient and impractical since the device needs to be unclipped prior to the bin being put out for collection. It is possible to not only forget to unclip the device, but once unclipped from the bin, it is then possible to misplace or lose the device.

The present invention relates to a device for use on this type of bin which seeks to address these issues by closing the lid after emptying and generally maintaining the lid in a closed position unless it is intended for the lid to be opened.

SUMMARY OF THE INVENTION

According to a first aspect of the present invention there is provided a bin lid closing device comprising:

a handle engaging portion for engaging with a handle of a bin;

a lid engaging portion extending outwardly from the handle engaging portion; and a securing means;

wherein the securing means engages with the bin to limit rotation of the handle engaging portion relative to the handle, and the lid engaging portion is engaged with the lid during opening of the lid and applies rotational force to the handle engaging portion, whereby the handle engaging portion provides resistance to the rotational force to bias the lid to a closed position.

According to a further aspect of the present invention there is provided a bin lid closing device comprising:

a lid engaging portion;

a securing means to engage with the bin; and an intermediate portion between the lid engaging portion and the securing means, whereby the intermediate portion mounts, in use, around or within a handle of the bin;

wherein the lid engaging portion extends outwardly from the intermediate portion to, in use, engage with the lid of the bin;

the securing means restricts rotation of the intermediate portion relative to the handle when the bin lid is moved between an open and closed position, and the lid engaging portion is engaged with the lid during opening of the lid and applies rotational force to the intermediate portion, and wherein the intermediate portion provides resistance to the rotational force to bias the lid engaging portion to apply a force to the lid to bias the lid to a closed position.

Preferably, the intermediate portion comprises a member that extends around at least a portion of the handle.

The intermediate portion may comprise a resilient member. For example, the intermediate portion may comprise a torsion spring.

More preferably, the intermediate portion may comprise a helical spring having at least one coil, and more preferably a plurality of coils.

The number of coils can be varied to suit a required specification and to provide the required degree of strength to the device. The helical spring is desirably a helical torsion spring.

In at least one embodiment, coils of the spring are adapted to fit around the handle of the bin.

It is preferred, though not limited to such, that the spring has a constant pitch and that the pitch and diameter of coils are configured and arranged to accommodate the handle and enable the spring to wind or be wound about the handle.

In an alternative arrangement, the spring is located internally of the handle.

The securing means is preferably located at an end of the spring and has a configuration which is arranged to engage with a portion of the bin.

Preferably, the securing means includes a portion, such as a hook, which engages with a bracket, fin, mounting for the handle on the body of the bin, or other protrusion extending outwardly from the bin.

The lid engaging portion is preferably disposed at an opposing end of the intermediate portion relative to the securing means.

The lid engaging portion preferably includes a first elongate member, extending outwardly from a longitudinal axis of the intermediate portion.

The lid engaging portion may also include a second elongate member, extending from an end of the first elongate member and disposed at an angle thereto. The second elongate member may be arranged adjacent to the bin lid when the device is fitted to the bin.

The lid engaging portion preferably has configuration to increase surface area contact with the lid.

It is preferred that the intermediate portion, lid engaging portion and securing means are formed or moulded as a single and continuous piece.

Preferably, the device is comprised of a suitably resilient material, such as a length of resilient wire.

The intermediate portion stores mechanical energy when the lid engaging portion is rotated during opening of the lid. The intermediate portion exerts a force in the opposite direction as the lid is opened, proportional to the angle that the lid engaging portion is rotated.

A further aspect of the present invention provides a bin lid closing device comprising:

a lid engaging portion;

a bin engaging portion; and an intermediate portion between the lid engaging portion and bin engaging portion, whereby at least part of the intermediate portion is arranged, in use, around, within and/or adjacent to a handle of the bin;

wherein the bin engaging portion extends outwardly from the intermediate portion to, in use, engage with the bin and the lid engaging portion extends outwardly from the intermediate portion to, in use, engage with a lid of the bin;

whereby the lid engaging portion is moveable between a first position when the bin lid is closed and a second position when the bin lid is opened and wherein the intermediate portion provides resistance to the lid engaging portion as the lid engaging portion is moved from the first position towards the second position to bias the lid engaging portion and apply a force to the lid to bias the lid to a closed position.

In one embodiment, the intermediate portion includes an elongate member that extends for at least a portion of a length of the bin handle. The intermediate portion further preferably includes a torsion spring.

It is preferred that the intermediate portion has a loop portion or coil arranged on one end thereof. It is further preferred that the intermediate portion has a loop portion or coil arranged at opposing ends of the intermediate portion, with a substantially straight elongate member therebetween.

The one or both loop portion or coil are configured and arranged to accommodate the handle and enable the device to be fitted onto the handle.

The bin engaging portion includes an elongate portion or arm, which extends out from an end of the intermediate portion and is arranged to engage with a portion of the bin. The bin engaging portion is, in use, disposed against a side wall of the bin.

In an alternative embodiment, the intermediate portion includes at least one torsion spring. The torsion spring can include at least one loop or coil. The intermediate portion further includes a handle engaging portion. In a preferred embodiment, the handle engaging portion is, in use, positioned on or adjacent to the handle of the bin.

BRIEF DESCRIPTION OF THE DRAWINGS

The invention will now be described, by way of example, with reference to the following drawings in which.

DESCRIPTION OF PREFERRED EMBODIMENT

Figure 1:
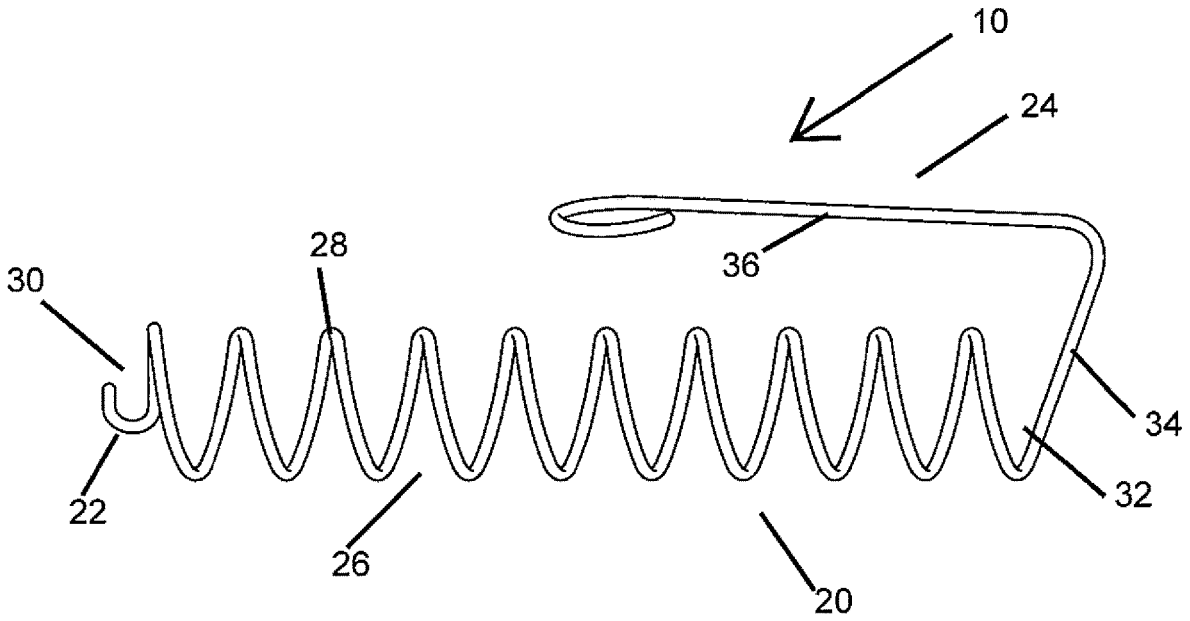
FIG. 1 is side view of a bin lid closing device in accordance with an embodiment of the present invention.
Figure 2:
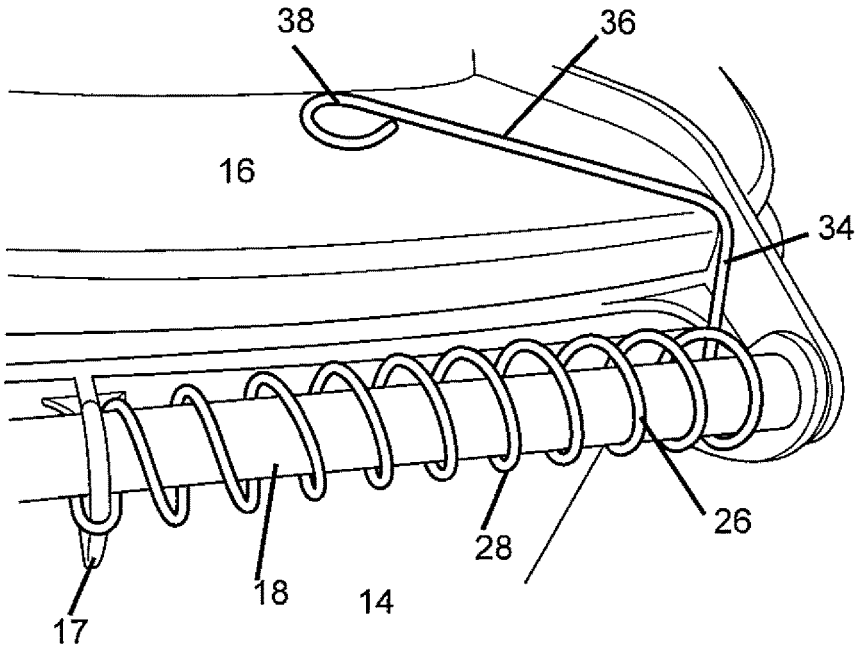
FIG. 2 is an upper perspective view of the bin lid closing device of FIG. 1 in engagement with a bin and bin lid.

Referring initially to FIGS. 1 to 4, there is shown a first embodiment of a bin lid closing device 10 for use on a bin 12 of known type, an example of which is often referred to as a 'wheelie' bin. However, it should be understood that the device 10 is suitable for use with any type of bin that has a lid hingedly attached thereto. The bin 12 comprises a body 14 formed generally from four side walls, defining a receptacle which typically holds rubbish and/or recyclables; and a lid 16. A cylindrical handle 18 is provided adjacent an upper end of a rear side wall of the bin 12. In the embodiment shown in FIGS. 3 and 4, the cylindrical handle 18 extends substantially along the length of the upper end of the rear side wall. The handle 18 is divided into substantially equal portions, each divided by a rib or fin 17, which extends outwardly substantially perpendicularly from the rear side wall of the bin 12 and has a portion that encircles the handle 18. The lid 16 is pivotally secured to the handle 18 in a generally known manner.

The bin lid closing device 10 broadly comprises an intermediate portion 20, securing means 22 and a lid engaging portion 24, which in use, operates to apply a force to the lid 16 to close the lid 16 and/or keep it in a closed position.

In the embodiment shown, the intermediate portion 20 comprises a helical spring 26 having at least one, preferable a plurality, of coils 28. The helical spring 26 is ideally a helical torsion spring which has capacity to store mechanical energy when twisted about its axis by rotation of the lid engaging portion 24 about the axis of the spring 26. Number of coils 28 of the spring 26 can be varied as required, including providing the required degree of strength to the device 10 to suit specific applications. For example, a greater number of coils 28 may be provided if the device 10 is intended to be used for closing a relatively larger or heavier lid 16, where more force is required to be applied to the lid 16 by the lid engaging portion 24.

The helical spring 26 is ideally open wound to avoid friction between coils 28 and to enable simple attachment of the device to the bin 12 and handle 18. However, it is possible for the spring 26 to be closed wound without departing from the scope of the present invention. Coils 28 of the spring 26 have diameter and pitch of dimensions to accommodate the handle 18. In the embodiment shown in the Figures, the helical spring 26 is arranged so that it is wound round the handle 18. In this embodiment, pitch and diameter of the coils are of a size sufficient to permit the spring 26 to fit onto the handle 18 and be wound on until all coils 28 are arranged about the handle 18. That is, inside diameter of the coils 28 are comparable with outer diameter of the handle 18, typically in the order of about 3 to 6 cm. The spring 26 has uniform or consistent pitch, with pitch being sufficiently wide to avoid or minimise risk of catching, for example, a persons fingers, in between coils 28. Pitch is typically about 2 to 5 cm, but can vary depending on, for example, dimensions of bin handle 18.

Figure 15:
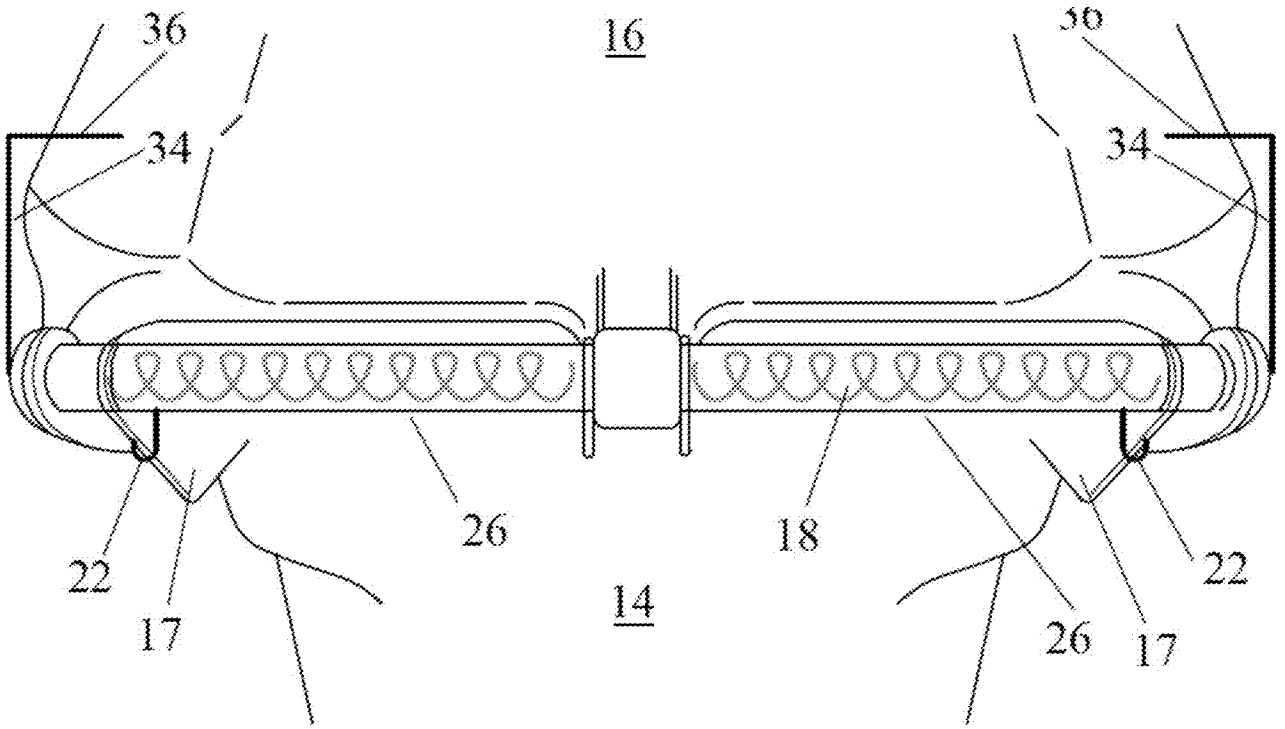
FIG. 15 is an upper perspective view of an alternative embodiment of the bin lid closing device of FIG. 5 in engagement with bin and bin lid.

In an alternative embodiment, as seen in FIG. 15, the spring 26 is located internally of the handle 18. In this embodiment, diameter of the coils 28 are relatively smaller, to enable the spring 26 to fit inside the handle 18.

Figure 3:
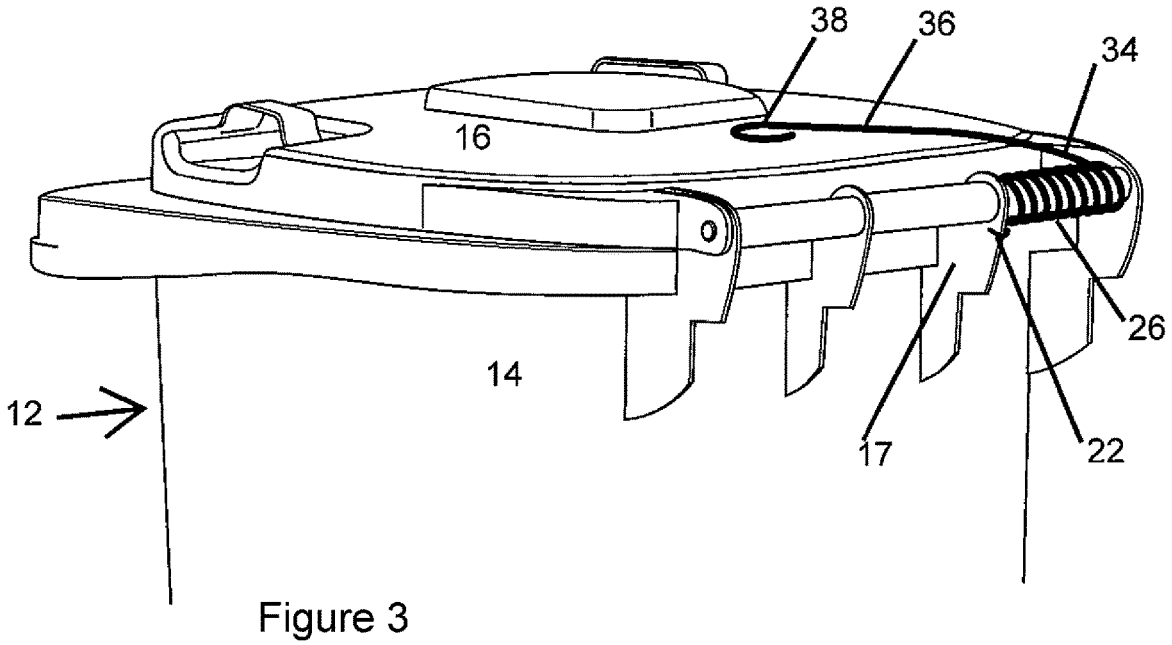
FIG. 3 is an upper perspective view of the bin lid closing device of FIG. 1 in engagement with a bin and lid, showing bin lid in a closed position.
Figure 4:
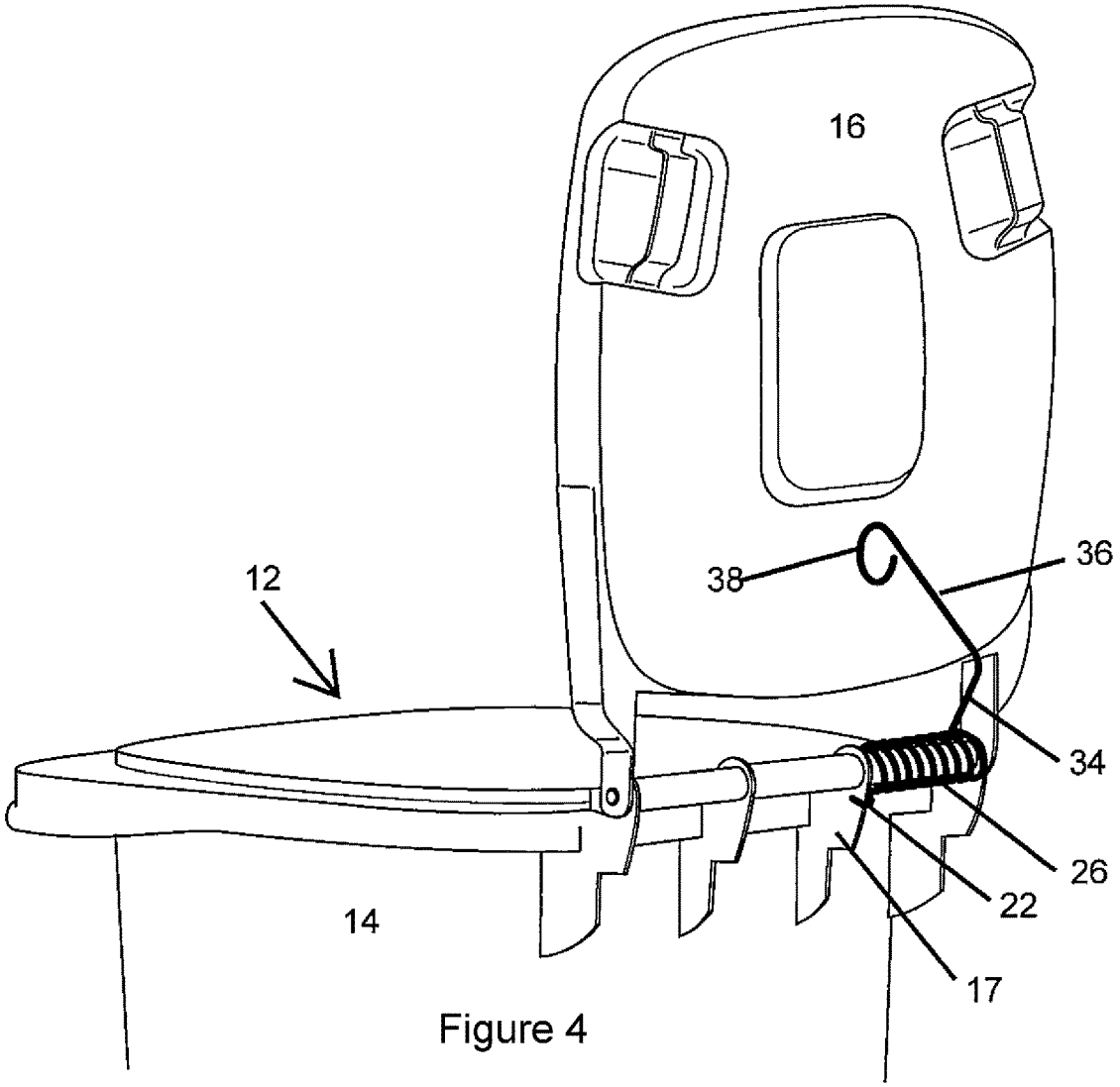
FIG. 4 is an upper perspective view of the bin lid closing device of FIG. 1 in engagement with bin and bin lid with lid in an open position.

The spring 26 has a longitudinal length that substantially extends the length of at least one portion of the handle 18. That is, a first end 30 of the spring 26 is located at one end of the handle portion and a second and opposite end 32 of the spring 26 is located at an opposing end of the handle portion. Referring to FIGS. 3 and 4, it is seen that the spring 26 extends substantially the length of an outer portion of the handle 18, with the first end 30 located adjacent a fin 17 extending outwardly from a rear side wall of the bin 12.

The securing means 22 is disposed at the first end 30 of the spring 26. In the embodiment shown in the Figures, the securing means 22 comprises a hook or substantially U-shaped portion. The hook is arranged to engage with a fin 17 or other suitable protrusion of the bin 12, engaging the device 10 with the bin 12 and preventing rotation of the handle engaging portion 20 about the axis of the handle 18 once the device 10 has been fitted to the bin 12 and its handle 18. The hook is thus adapted to secure the first end 30 of the spring 26 onto the bin 12 when the spring 26 has been wound about the handle 18.

The lid engaging portion 24 is disposed at the second end 32 of the spring 26. The lid engaging portion 24 includes a first elongate member 34 extending outwardly from the spring 26. The first elongate member 34 extends outwardly at an angle to the axis of the spring 26 and bin handle 18. A second elongate member 36 extends from the first elongate member 34. The second elongate member 36 is disposed at an angle relative to the first elongate member 34 such that the second elongate member 36 is arranged adjacent to the lid 16 when the device 10 is attached to the bin 12.

At least a portion of the lid engaging portion 24 is arranged to increase contact with the lid 16. In the embodiment shown in FIGS. 1 to 4, this portion comprises a looped portion 38 disposed at an end of the second elongate member 36, whereby the end of second elongate member 36 is bent into a loop or ring. The loop or ring is arranged to lie adjacent a surface of the lid 16 when the device 10 is attached to the bin 12.

The intermediate portion 20, lid engaging portion 24 and securing means 22 are formed or moulded as a single piece device. In the embodiment shown in the Figures, the device 10 comprises a single length of resilient wire, such as a galvanised stainless steel, bent and twisted into shape and configuration as required. The wire can be flat or round, and have a gauge or diameter suitable to impart required strength to the device 10. The wire typically has gauge between about 2 to 5 mm. The wire or portions thereof can optionally be coated with a material, such as a plastic or powder coating, to protect the device 10 from environmental stressors and/or provide ability to add aesthetic features to the device 10.

Optionally, at least a portion of the second elongate member 36 is substantially planar, which not only increases surface area contact with the lid 16, but also provides a surface onto which text, branding or other visual aspect can be displayed.

In use, the device 10 is wound onto a portion of the bin handle 18 by placing the coil 28 nearest the first end 30 of the spring 26 onto the handle and applying sufficient force that the handle 18 is inserted in between this coil 28 and the coil adjacent thereto. The spring 26 is then wound onto the handle 18 by rotation of the lid engaging portion 24, which winds the spring 26, one coil at a time, about the handle 18. This is continued until all coils 28 of the spring 26 are arranged about the handle 18.

The device 10 is then locked into position on the bin 12 by engaging the hook of the securing means 22 onto a fin 17 of the bin 12. This engagement prevents rotational movement of the spring 26 about the handle 18 as the lid 16 is pivoted between open and closed position.

Direction of winding, i.e. clockwise or anticlockwise, of the spring 26 onto the handle 18 depends on the direction of wind of the spring 26. In the embodiment shown in FIGS. 1 to 4, where the first end 30 of the spring 26 is located on the left, the spring 26 has a right hand wind. This is reversed if the first end 30 is located to the right.

In the embodiment where at least part of the intermediate portion 20, being substantially all of the spring 26 is located within the handle 18, the device 10 can be integrated with the bin during manufacture of the bin.

Figure 5:
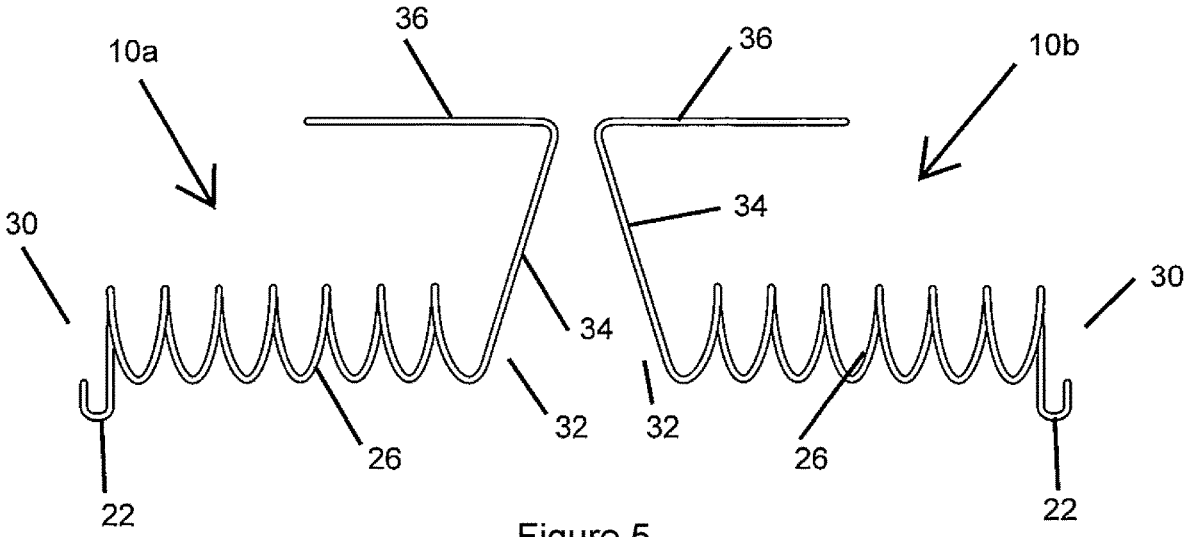
FIG. 5 is a side view of a second embodiment of the bin lid closing device.
Figure 6:
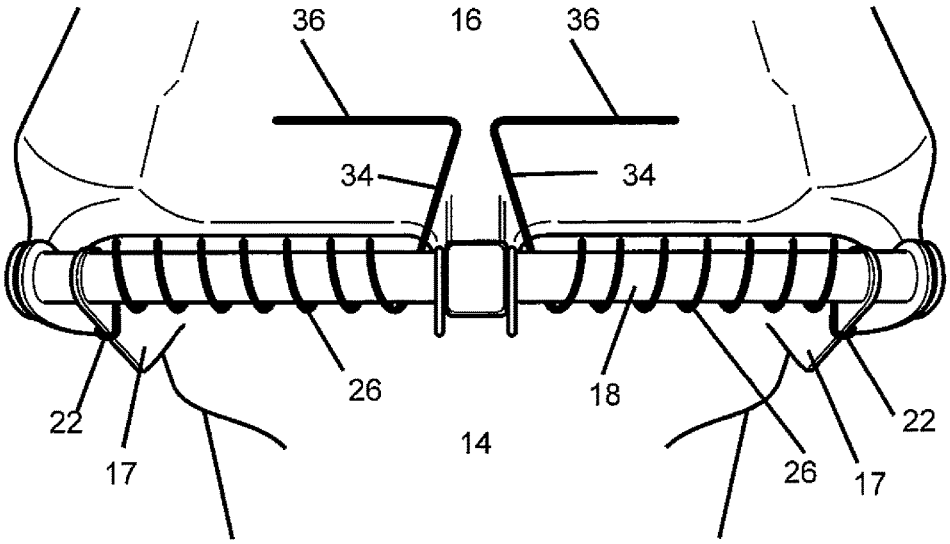
FIG. 6 is an upper perspective view of the bin lid closing device of FIG. 5 in engagement with bin and bin lid.
Figure 7:
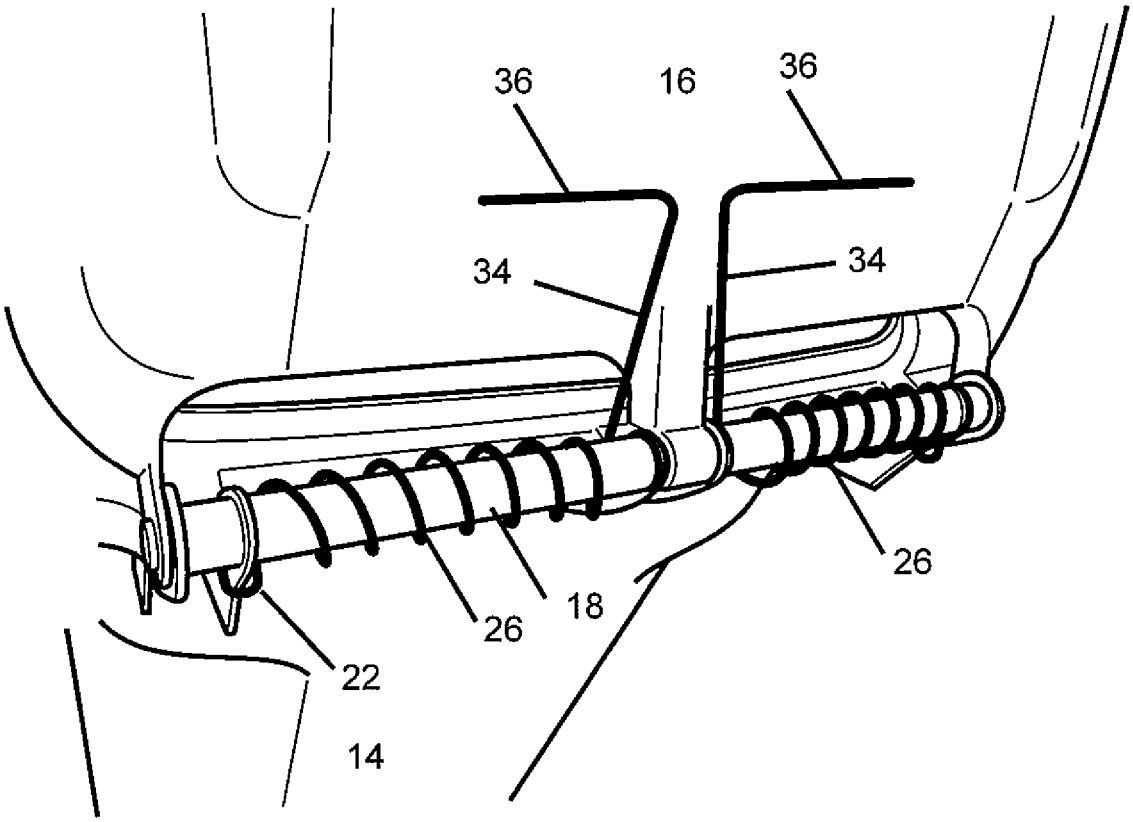
FIG. 7 is an upper perspective view of the bin lid closing device of FIG. 5 in engagement with bin and lid, with lid in a partially open position.

Both left and right hand wind arrangements are shown in FIGS. 5 to 7, which illustrate an alternative embodiment of the present invention. This embodiment has particular utility where the bin lid 16 is larger or heavier, or a greater amount of force is required to be applied to the lid 16, for example to prevent the lid 16 from being pivoted open past a particular angle.

In the embodiment shown in FIGS. 5 to 7, there are two devices 10*a* and 10*b*, which are each essentially mirror images of each other. Device 10*a* is arranged to fit on a left side of the handle 18 and device 10*b* is arranged to fit on a right side of the handle 18. The Figures show the devices 10*a*, 10*b* with securing means 22 located at outer ends of the handle 18 and secured to fins 17 extending from the rear wall of the bin 12. However, it is within the scope of this invention for the devices 10*a*, 10*b* to be arranged on the handle 18 in an opposite direction, whereby the securing means 22 engages with fins 17 located at a mid point of the handle 18. The particular arrangement is largely dependent on configuration of the handle 18 and location of fins 17, which can vary between different bins 12.

In this embodiment, the lid engaging portion 24 also includes a first elongate member 34 and second elongate member 36. The second elongate member 36 extends outwardly from an end of the first elongate member 34 at an angle therefrom. The angle is desirably between about 45° to 135° relative to the first elongate member 34.

In each of the embodiments, the pivoting movement of the lid 16 as it moves between closed and open position causes rotational movement of the lid engaging portion 24 about the axis of the spring 26. The spring 26 provides resistance to the rotational force applied by the lid engaging portion 24 as the lid 16 is opened, ensuring the lid 16 is biased towards the closed position.

As the lid 16 is opened, the lid engaging portion 24 is deflected, causing the spring 26 to tighten up about the handle 18 and exert force upon the lid engaging portion 24 to cause the lid 16 to return to a closed position. An opposing force must therefore be applied to the lid 16 to counter the bias of the lid engaging portion 24 to return the lid 16 to the closed position. This opposing force is typically provided either through the action of the bin 12 being turned upside down during mechanical emptying, or by a person actively opening the lid 16.

If it is desired to allow the lid 16 to remain in an open position, it is necessary to first unfasten the securing means 22 by unhooking it from the fin 17. The hook can be pried off the fin 17 using a suitable tool or lever or by hand. The securing means 22 is re-engaged with the fin 17 once it is desired to keep the lid 16 closed.

Figure 8:
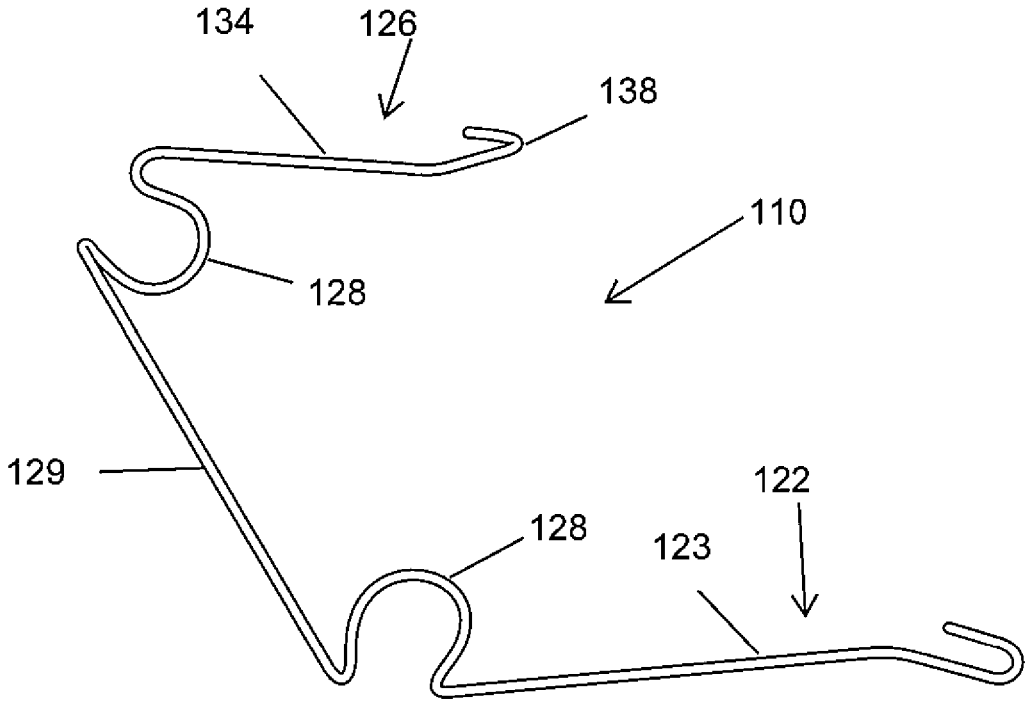
FIG. 8 is an upper perspective of a third embodiment of the bin lid closing device.
Figure 9:
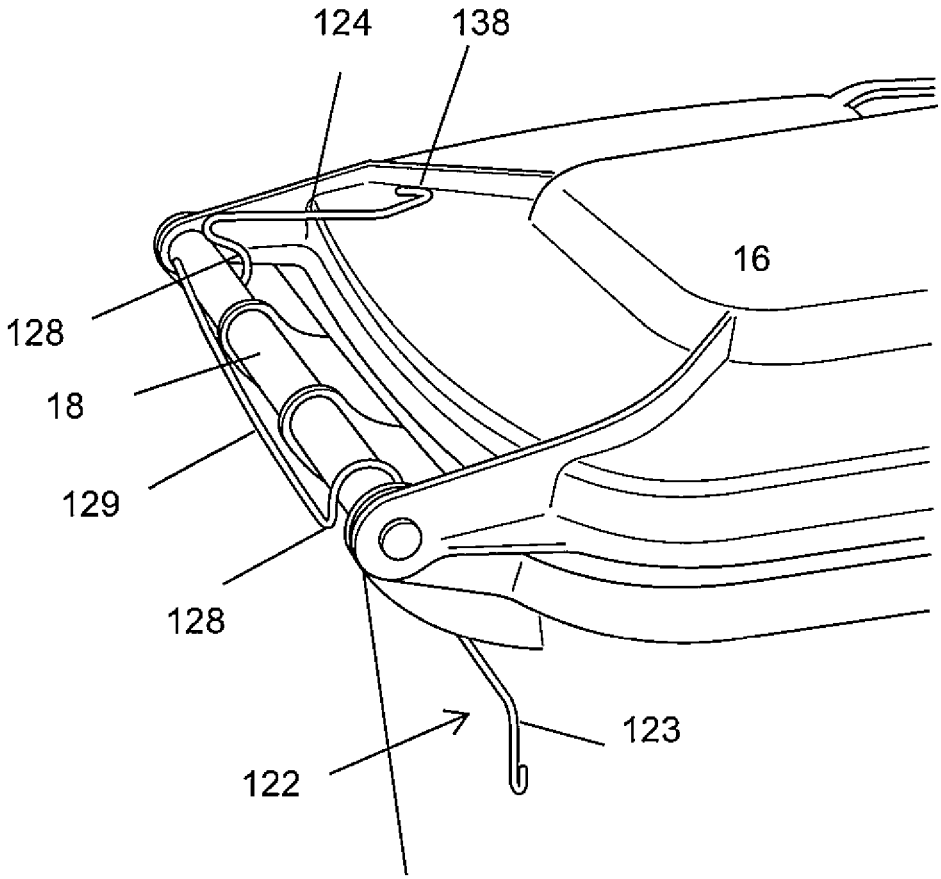
FIG. 9 is an upper perspective of the bin lid closing device of FIG. 8 in engagement with bin and bin lid.
Figure 10:
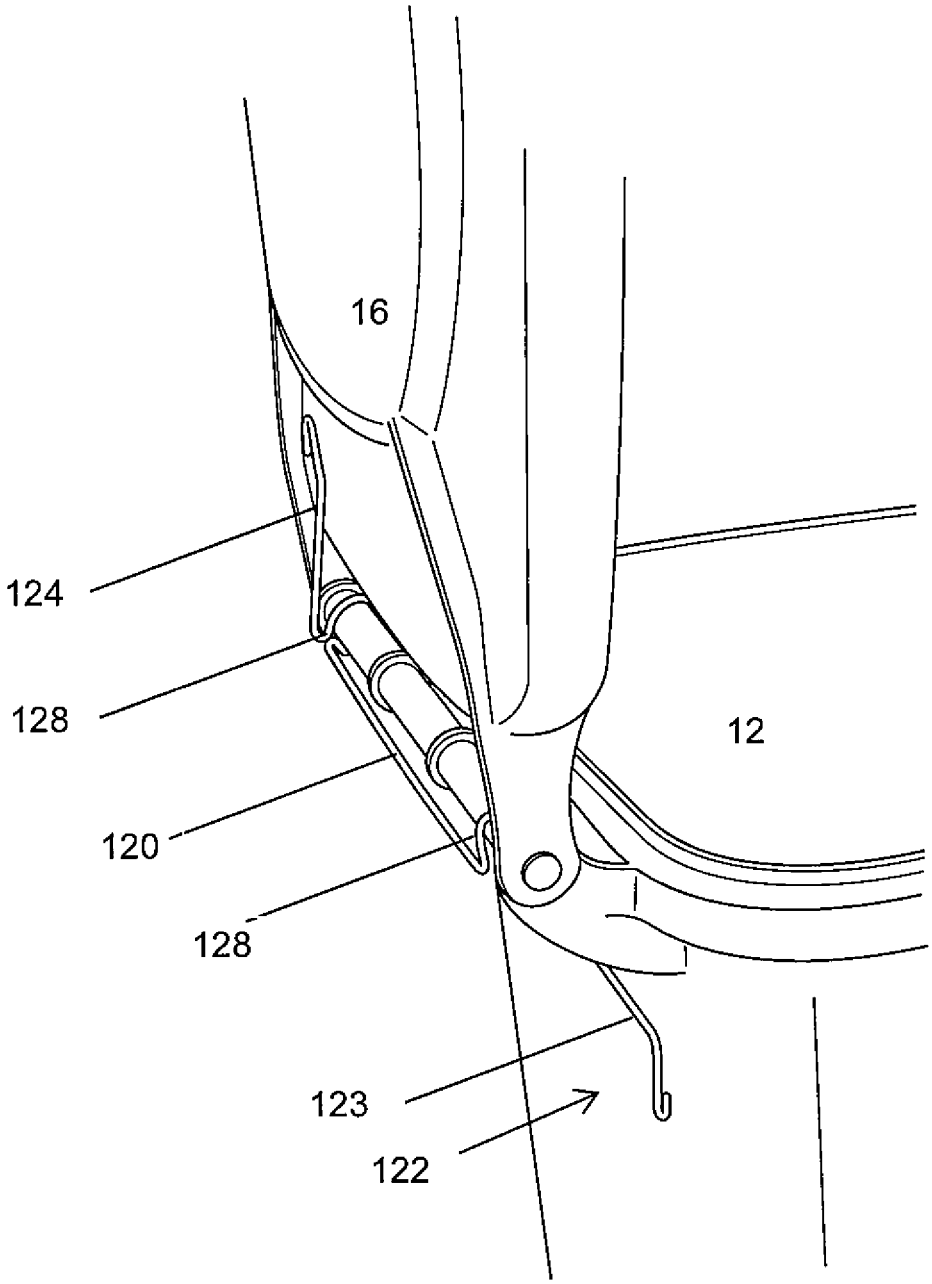
FIG. 10 is a perspective view of the bin lid closing device of FIG. 8 in engagement with bin and lid, with lid in an open position.

Referring now to FIGS. 8 to 10, there is shown a further embodiment of the bin lid closing device 110, where like numerals refer to like features of the previously described embodiments. The device 110 includes an intermediate portion 120 having a curved portion 128 or loop portion disposed at opposing ends thereof. Each curved portion 128 or loop portion forms a substantially C or U shape. An elongate portion 129 is disposed between the opposing curved portions 128.

The curved portions 128 function as a torsion spring, having capacity to store mechanical energy when twisted or tightened by rotation of the lid engaging portion 124 about the axis of the bin handle or elongate portion 129 of the intermediate portion 120.

The curved portions 128 each have configuration and dimension to accommodate the handle 18. Each curved portion 128 is mounted onto the handle 18 such that the elongate portion 129 is arranged adjacent a length of the handle 18.

The bin engaging portion 122 includes an arm 123 which extends outwardly from a curved portion 128 of the intermediate portion 120. In use, the arm 123 is arranged to lie adjacent to a side wall of the bin 12. In the embodiment shown, an end of the arm 123 distal to the curved portion 128 has a looped portion or other similar structure arranged to increase surface area contact with the side wall of the bin 12. The bin engaging portion 122 prevents movement of the elongate portion 129 of the intermediate portion 120 about the axis of the handle 18 once the device 110 has been fitted to the bin 12 and the handle 18.

The lid engaging portion 124 is disposed at an end of the intermediate portion 120 opposite to the bin engaging portion 122. As in previous embodiments, the lid engaging portion 124 includes at least a first elongate member 134 extending outwardly from the curved portion 128. The first elongate member 134 extends outwardly at an angle to the axis of the intermediate portion 120 and bin handle 18.

At least a portion of the lid engaging portion 124 is arranged to increase surface area contact with the lid 16. In the embodiment shown, this portion includes a loop or hook portion 138 disposed at an end of the lid engaging portion 124. The loop or hook portion 138 is arranged to lie adjacent a surface of the lid 16 when the device 110 is attached to the bin.

The device 110 is attached to the bin handle 18 by fitting the respective curved portions 128 of the intermediate portion 120 onto the handle such that the bin engaging portion 122 is disposed adjacent a wall of the bin 12 and the lid engaging portion 124 is disposed adjacent a surface of the lid 16. The engagement of the bin engaging portion 122 with the bin wall prevents rotational movement of the elongate portion 129 of the intermediate portion 120 about the handle 18 as the lid 16 is pivoted between open and closed position.

As the lid 16 is pivoted from a closed position to an open position, the lid engaging portion 124 is rotated about the axis of the intermediate portion 120 and handle 18. The curved portion 128 provides resistance to rotational force applied by the lid engaging portion 124 as the curved portion 128 is twisted or tightened around the handle 18. The curved portion 128 provides resistance to the lid engaging portion 124 as the lid 16 is moved towards a more open position, ensuring that the lid 16 is biased towards the closed position.

As in previous embodiments, as the lid 16 is opened, the lid engaging portion 124 is deflected, causing the curved portion 128 to tighten up about the handle and exert force upon the lid engaging portion 124 to cause the lid 16 to return to a closed position.

Figure 11A:
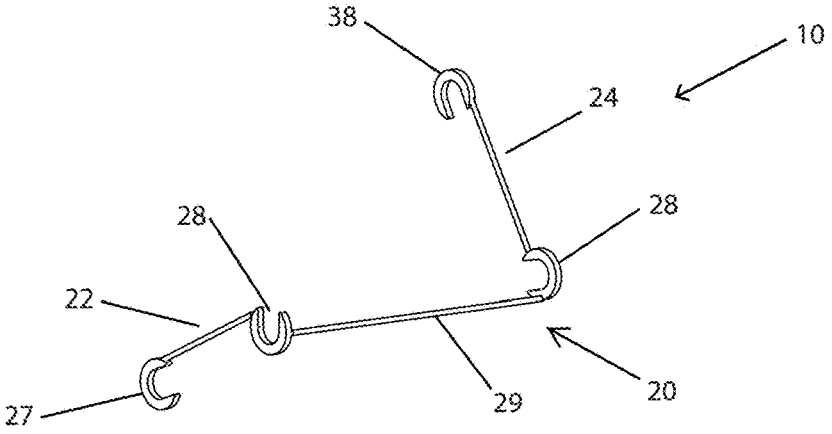
FIG. 11*a* is a perspective view of a fourth embodiment of the bin lid closing device.
Figure 11B:
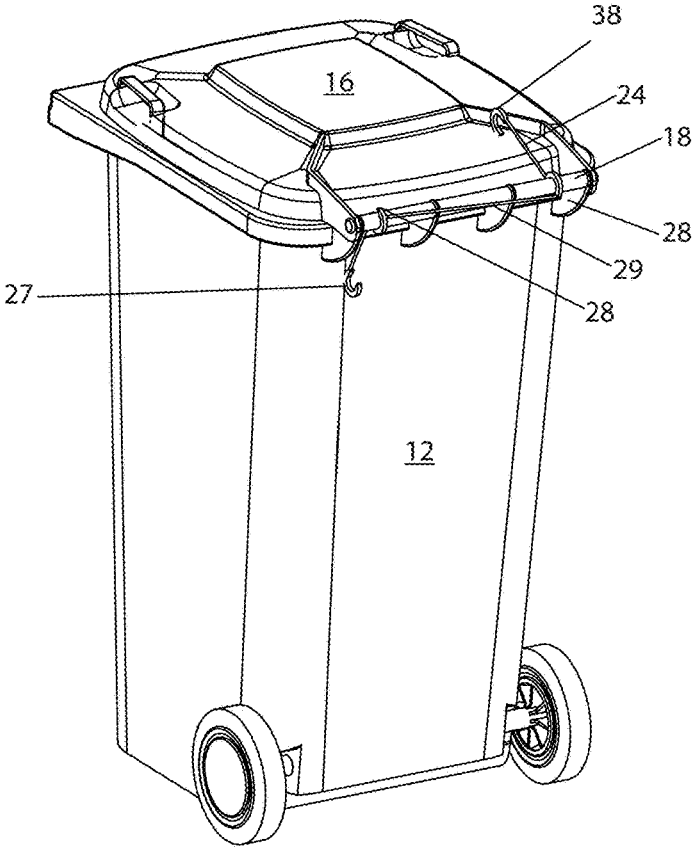
FIG. 11*b* is a perspective view of the bin lid closing device of FIG. 11*a* in engagement with bin and lid.

Referring now to FIGS. 11*a* and 11*b*, there is shown a further embodiment of the bin lid closing device 10. As per the previous embodiment (FIGS. 8-10), the device 10 includes an intermediate portion 20 having a curved portion or hook 28 disposed at opposing ends thereof. An elongate portion 29 is disposed between the opposing curved portions 28.

The curved portions 28 and elongate portion 29 together function as a torsion spring which functions to bias the lid engaging portion 24 against the bin lid 16 towards a closed position.

The bin engaging portion 22 includes an arm which extends outwardly from a curved portion 28 of the intermediate portion 20. In this embodiment, an end of the arm distal to the curved portion 28 has an end hook 27. Usefully, the end hook 27 is disposed such that items, e.g. rubbish bags, can be hung onto the bin by the end hook 27.

The lid engaging portion 24 is similar to earlier embodiments and as per the embodiment shown in FIGS. 8-10, includes a hook portion 38 at an end thereof. The hook portion 38 can be oriented in any position relative to the surface of the lid 16. As an example, the hook portion 38 may rest flat against the lid 16 or be disposed such that a point of the hook portion 38 is located on the lid 16 in use, as is shown in FIG. 11*b*

Figure 12A:
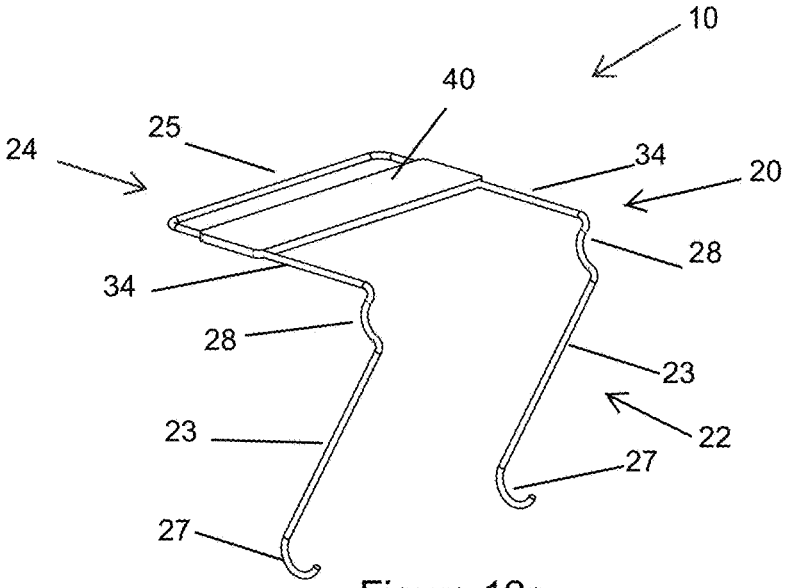
FIG. 12*a* is a perspective view of a fifth embodiment of the bin lid closing device.
Figure 12B:
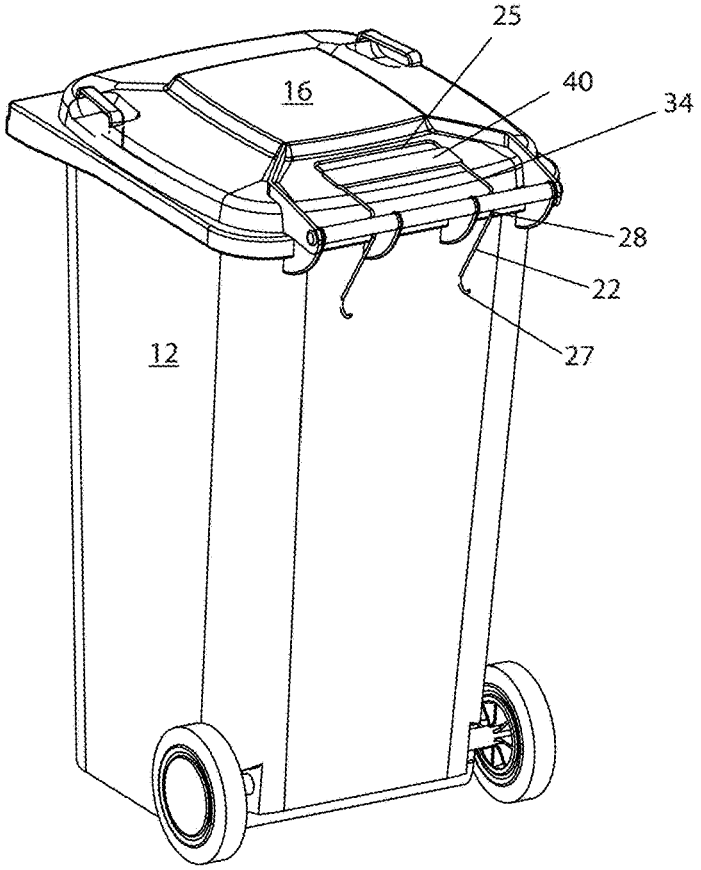
FIG. 12*b* is a perspective view of the bin lid closing device of FIG. 12*a* in engagement with bin and lid.

Referring now to FIGS. 12*a* and 12*b*, there is shown a further embodiment of the device 10 where the intermediate portion 20 includes a pair of curved portions 28. The curved portions 28 are arranged to seat or engage with the bin handle 18. The curved portions 28 thus have a size and configuration comparable to the size and dimensions of the handle 18.

This embodiment has two bin engaging portions 22, comprising an arm 23 which extends outwardly from each of the curved portions 28. Each arm 23 terminates in a hook portion 27, from which items can be hung when the device 10 is engaged with the bin 12.

The lid engaging portion 24 in this embodiment includes a pair of arms 34 extending outwardly from respective curved portions 28 and arranged substantially parallel to each other. An elongate member 25 traverses the pair of arms 34, substantially perpendicular to ends of each of the arms 34. The elongate member 25 provides increased contact between the lid engaging portion 24 and the bin lid 16.

A second elongate member 40 traverses the pair of arms 34 between an intermediate point of the arms 34. In the embodiment shown, the second elongate member 40 is a substantially planar member, providing a surface onto which branding, instructional text or other visual aspects can be displayed.

In this embodiment, the arrangement of bin engaging portions 22 and lid engaging portion 24 about the intermediate portion consisting of the pair of curved portions 28 operates to bias the lid engaging portion 24 against the bin lid 16 and towards a closed position when the lid 16 is opened.

Figure 13A:
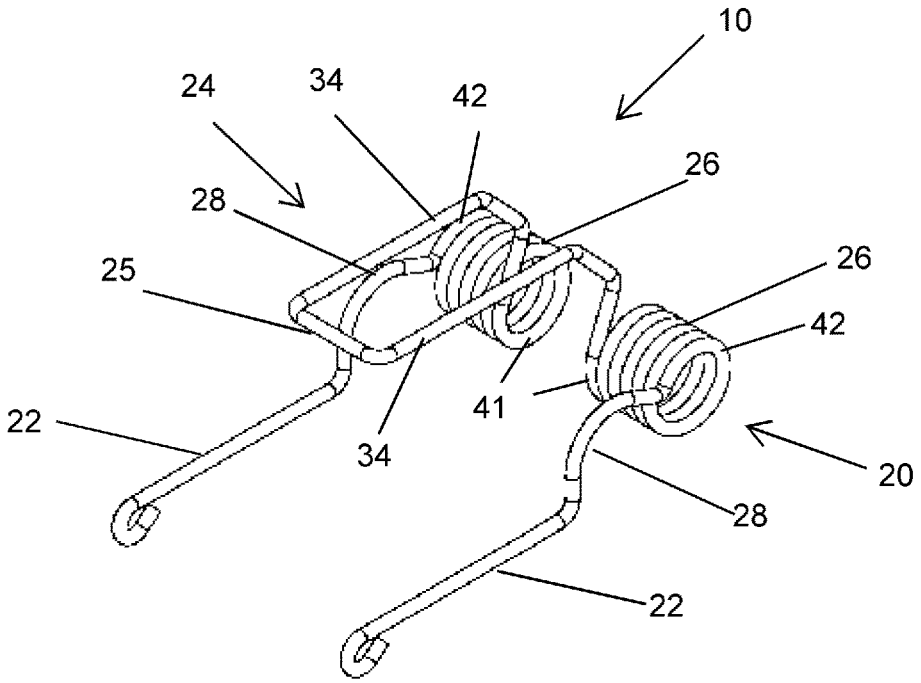
FIG. 13*a* is a perspective view of a sixth embodiment of the bin lid closing device.
Figure 13B:
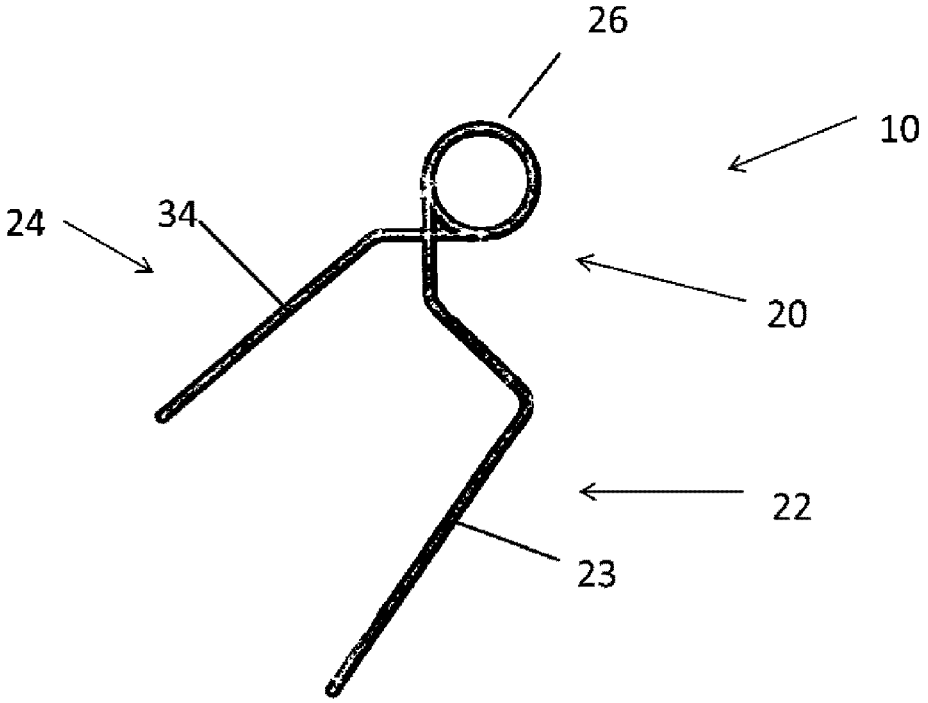
FIG. 13*b* is a side perspective view of the embodiment of FIG. 13*a;*

Referring now to FIGS. 13*a* and 13*b*, there is shown a further embodiment of the device 10. In this embodiment, the intermediate portion 20 includes a pair of springs 26, each having at least one, ideally a plurality of coils 28. The plurality of coils 28 of each spring 26 includes an inner coil 41 and an outer coil 42.

Each spring 26 has a handle engaging portion 28 extending outwardly therefrom. In the embodiment shown in FIGS. 13*a* and 13*b*, the handle engaging portion 28 extends outwardly from the outer coil 42. The handle engaging portion 28 is arranged to seat or otherwise engage with the handle 18 of the bin. In the embodiment shown in FIG. 13*a*, the handle engaging portion is arranged as a pair of curved portions, each curve having configuration and dimensions comparable to the bin handle 18. However, the handle engaging portion 28 may be provided in other suitable configurations, arranged to seat against the handle 18 of the bin.

A bin engaging portion 22 extends outwardly from an end of each handle engaging portion 28. Each bin engaging portion 22 is arranged in use, to lie adjacent a wall of the bin 12.

The lid engaging portion 24 includes a pair of arms 34, each extending outwardly from the inner coil 41 of each spring 26. The arms 34 are substantially parallel to each other and an elongate member 25 traverses the arms at respective ends thereof.

The device 10 according to this embodiment is advantageously readily engagable with the bin 12 and bin handle 18. The handle engaging portions 28 are placed on top of the handle 18 with bin engaging portions 22 resting against a wall of the bin 12. The lid engaging portion 24 can be pulled upwardly, tensioning the springs 26, to enable the lid engaging portion 24 to be positioned atop the lid 16.

Once appropriately positioned on the bin 12 and handle 18, the torsion springs 26 each operate to bias the lid 16 towards a closed position when the lid is opened 16 by application of a downwards force by the lid engaging portion 24.

Figure 14A:
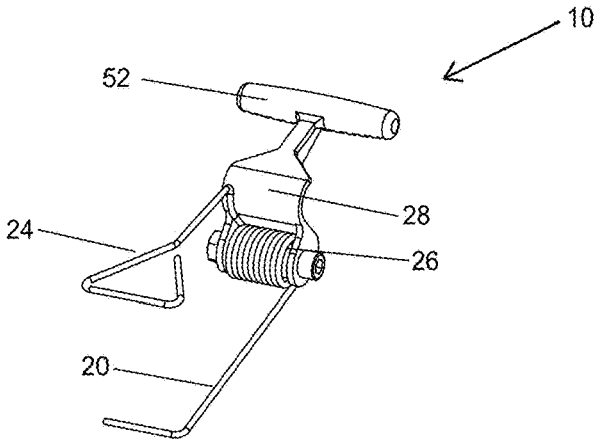
FIG. 14*a* is a perspective view of a seventh embodiment of the bin lid closing device.
Figure 14B:
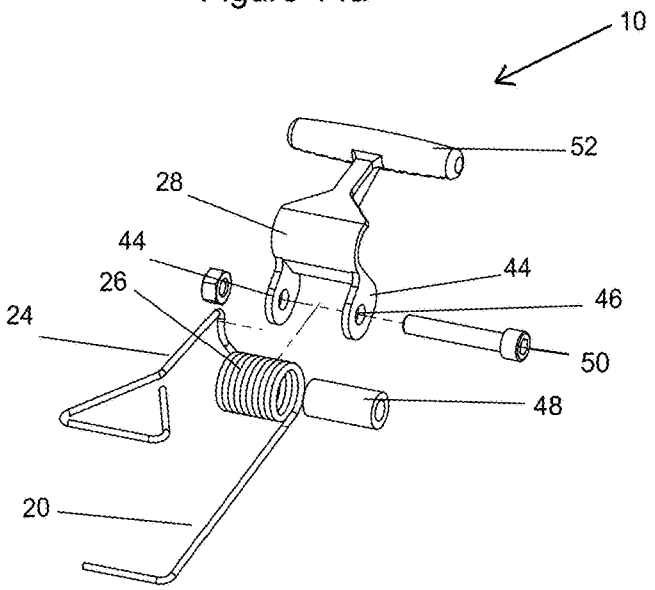
FIG. 14*b* is an exploded perspective view of the bin lid closing device of FIG. 14*a*.
Figure 14C:
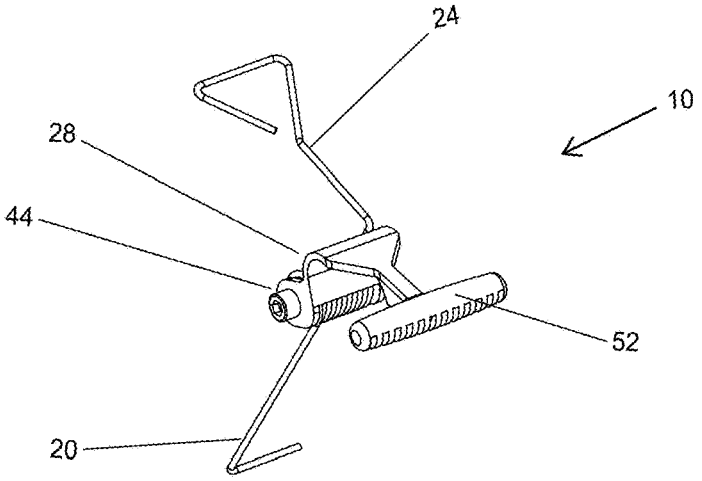
FIG. 14*c* is a perspective view of the bin lid closing device of FIG. 14*a* in engagement with a bin and bin lid.

Referring now to FIGS. 14*a* to 14*c*, there is shown yet a further embodiment of the device 10. The device 10 of this embodiment has a lid engaging portion 24 and bin engaging portion 20 substantially as described with reference to earlier embodiments. A spring 26 is located between the lid and bin engaging portions 24, 20.

The device 10 further includes a handle engaging portion which includes a generally curved portion 28 having a configuration comparable to at least part of the circumference of the handle 18. A pair of flanges 44 extend outwardly from one end of the curved portion 28, each flange 44 having an aperture 46. A handle 52 extends outwardly from the opposing end of the curved portion 28. The handle 52, curved portion 28 and flanges 44 can be manufactured from a resilient material, such as a plastic.

An elongate hollow member 48 is disposed through the coils of the spring 26. In the embodiment shown, the elongate hollow member 48 is a cylinder. The apertures 46 of the flanges 44 are in alignment with open ends of the elongate hollow member 48, enabling the cylinder to receive a bolt 50 or other similar structure such as pin or shaft, thereby attaching flanges 44, curved portion 28 and handle 52 to the spring 26.

With an inner curve of the curved portion 28 resting or seated on the handle 18, downwards force can be applied to the handle 52 to disengage the lid engaging portion 24 with the lid 16 to enable the lid 16 to be opened without the device 10 biasing the lid 16 to a closed position.

In each of the embodiments described, the device 10 has been described as being wholly or substantially external to the bin 12 and handle 18. However, any of the embodiments described are suitable for incorporating into the design of the bin itself, including combining or integrating into the bin manufacturing process. In each embodiment, at least part of the intermediate portion 20, typically the spring 26 and/or curved portion 28 can be located inside the handle 18.

It will be readily apparent to persons skilled in the relevant art that various modifications and improvements may be made to the invention, in addition to those embodiments already described, without departing from the basic inventive concepts of the present invention.

The claims defining the invnetion are as follows:

1. A bin lid closing device comprising:

a lid engaging portion;

a securing means to engage with the bin; and an intermediate portion between the lid engaging portion and the securing means, whereby the intermediate portion comprises at least one resilient member that mounts, in use, within a handle of the bin, wherein:

the lid engaging portion extends outwardly from the intermediate portion to, in use, engage with the lid of the bin, the securing means restricts rotation of the intermediate portion relative to the handle when the bin lid is moved between an open and closed position, the lid engaging portion applies a closing biasing force to the lid when the lid is in the closed position and during opening of the lid and applies rotational force to the intermediate portion, and the intermediate portion provides resistance to the rotational force to bias the lid engaging portion to apply the closing biasing force to the lid to bias the lid to the closed position.

2. A bin lid closing device according to claim 1, wherein the intermediate portion comprises at least one helical spring.

3. A bin lid closing device according to claim 2, wherein the at least one helical spring has a plurality of coils.

4. A bin lid closing device according to claim 2, wherein the at least one helical spring includes a helical torsion spring.

5. A bin lid closing device according to claim 2, wherein the coils of the at least one helical spring have a constant pitch and the pitch and diameter of the coils are configured and arranged to be accommodated within the handle and enable the spring to wind or be wound within the handle.

6. A bin lid closing device according to claim 1, wherein the securing means is located at an end of the intermediate portion and has a configuration which is arranged to engage with a portion of the bin.

7. A bin lid closing device according to claim 1, wherein the securing means comprises a portion which engages with a bracket, fin, mounting for the handle on a body of the bin, or other protrusion extending outwardly from the bin.

8. A bin lid closing device according to claim 1, wherein the lid engaging portion includes a first elongate member, extending outwardly from a longitudinal axis of the intermediate portion.

9. A bin lid closing device according to claim 8, wherein the lid engaging portion further includes a second elongate member, extending from an end of the first elongate member and disposed at an angle thereto.

10. A bin lid closing device according to claim 9, wherein the second elongate member is arranged adjacent to the bin lid when the device is fitted to the bin.

11. A bin lid closing device according to claim 1, wherein the lid engaging portion has a configuration to increase surface area contact with the lid.

12. A bin lid closing device according to claim 1, wherein the intermediate portion, lid engaging portion and securing means are formed or moulded as a single and continuous piece.

13. A bin lid closing device according to claim 1, wherein at least part of the intermediate portion stores mechanical energy when the lid engaging portion is rotated during opening of the lid.

14. A bin lid closing device according to claim 1, wherein the intermediate portion exerts a force in the opposite direction as the lid is opened, the force being proportional to the angle that the lid engaging portion is rotated about the axis of the intermediate portion.

15. A bin closing device comprising:

a handle engaging portion for engaging with a handle of a bin;

an intermediate portion comprising at least one resilient member within the handle;

a lid engaging portion extending outwardly from the handle engaging portion; and a securing means, wherein;

the securing means engages with the bin to limit rotation of the handle engaging portion relative to the handle, and the lid engaging portion applies a closing biasing force to the lid when the lid is in a closed position and during opening of the lid and applies rotational force to the handle engaging portion, whereby the handle engaging portion provides resistance to the rotational force to bias the lid to the closed position.

16. A bin lid closing device according to claim 15, wherein the intermediate portion comprises at least one helical spring.

17. A bin lid closing device according to claim 16, wherein the at least one helical spring has at least one coil.

18. A bin lid closing device according to claim 17, wherein the at least one coil of the at least one helical spring is adapted to fit within the handle of the bin.

19. A bin lid closing device according to claim 18, wherein the at least one helical spring has a constant pitch, and pitch and diameter of the at least one coil are configured and arranged to accommodate within the handle and enable the spring to wind or be wound within the handle.

20. A bin lid closing device according to claim 16, wherein the at least one helical spring includes a helical torsion spring.

21. A bin lid closing device according to claim 15, wherein the securing means is located at an end of the intermediate portion and has a configuration which is arranged to engage with a portion of the bin.

22. A bin lid closing device according to claim 15, wherein the securing means comprises a portion which engages with a bracket, fin, mounting for the handle on a body of the bin, or other protrusion extending outwardly from the bin.

23. A bin lid closing device according to claim 15, wherein the lid engaging portion includes a first elongate member, extending outwardly from a longitudinal axis of the intermediate portion.

24. A bin lid closing device according to claim 23, wherein the lid engaging portion further includes a second elongate member, extending from an end of the first elongate member and disposed at an angle thereto.

25. A bin lid closing device according to claim 24, wherein the second elongate member is arranged adjacent to the bin lid when the device is fitted to the bin.

26. A bin lid closing device according to claim 15, wherein the lid engaging portion has a configuration to increase surface area contact with the lid.

27. A bin lid closing device according to claim 15, wherein the intermediate portion, lid engaging portion and securing means are formed or moulded as a single and continuous piece.

28. A bin lid closing device according to claim 15, wherein at least part of the intermediate portion stores mechanical energy when the lid engaging portion is rotated during opening of the lid.

29. A bin lid closing device according to claim 15, wherein the intermediate portion exerts a force in the opposite direction as the lid is opened, the force being proportional to the angle that the lid engaging portion is rotated about the axis of the intermediate portion.

30. A bin lid closing device comprising:

a lid engaging portion;

a bin engaging portion; and an intermediate portion between the lid engaging portion and bin engaging portion, whereby the intermediate portion includes a resilient member is arranged, in use, within a handle of the bin;

wherein the bin engaging portion extends outwardly from the intermediate portion to, in use, engage with the bin and the lid engaging portion extends outwardly from the intermediate portion to, in use, engage with a lid of the bin;

whereby the lid engaging portion is moveable between a first position when the bin lid is closed and a second position when the bin lid is opened and wherein the intermediate portion biases the lid engaging portion to apply a closing force to the bin lid when opening the bin lid from the first position when the bin lid is closed and provides resistance to the lid engaging portion as the lid engaging portion is moved from the first position towards the second position to bias the lid engaging portion and apply the closing force to the bin lid to bias the lid to the first position.

31. A bin lid closing device according to claim 30, wherein the intermediate portion comprises at least one spring.

32. A bin lid closing device according to claim 31, wherein the at least one spring has at least one coil.

33. A bin lid closing device according to claim 31, wherein the at least one spring includes at least one helical torsion spring.

34. A bin lid closing device according to claim 30, wherein the securing means is located at an end of the intermediate portion and has a configuration which is arranged to engage with a portion of the bin.

35. A bin lid closing device according to claim 30, wherein the securing means comprises a portion which engages with a bracket, fin, mounting for the handle on a body of the bin, or other protrusion extending outwardly from the bin.

36. A bin lid closing device according to claim 30, wherein the lid engaging portion includes a first elongate member, extending outwardly from a longitudinal axis of the intermediate portion.

37. A bin lid closing device according to claim 36, wherein the lid engaging portion further includes a second elongate member, extending from an end of the first elongate member and disposed at an angle thereto.

38. A bin lid closing device according to claim 37, wherein the second elongate member is arranged adjacent to the bin lid when the device is fitted to the bin.

39. A bin lid closing device according to claim 30, wherein the lid engaging portion has a configuration to increase surface area contact with the lid.

40. A bin lid closing device according to claim 30, wherein at least part of the intermediate portion stores mechanical energy when the lid engaging portion is rotated during opening of the lid.

41. A bin lid closing device according to claim 30, wherein the intermediate portion exerts a force in the opposite direction as the lid is opened, the force being proportional to the angle that the lid engaging portion is rotated about the axis of the intermediate portion.

42. A bin lid closing device according to claim 30, wherein the intermediate portion, lid engaging portion and securing means are formed of a continuous wire.

* * * * *